United States Patent [19]

Litchfield et al.

[11] 4,330,575

[45] May 18, 1982

[54] COATING MATERIAL

[75] Inventors: William B. Litchfield, Toton; John T. Gent, South Normanton; James A. S. Graham, Borrowash, all of England

[73] Assignee: Rolls-Royce Limited, London, England

[21] Appl. No.: 228,198

[22] Filed: Jan. 26, 1981

[30] Foreign Application Priority Data

Mar. 22, 1980 [GB] United Kingdom ..... 8009750

[51] Int. Cl.[3] ..... B05D 1/08

[52] U.S. Cl. ..... 427/376.3; 75/252; 427/376.6; 427/217; 427/423; 427/404; 428/406; 428/325; 428/328

[58] Field of Search ..... 75/252; 427/190, 191, 427/423, 376.3, 376.6, 404, 217; 428/406, 325, 328

[56] References Cited

U.S. PATENT DOCUMENTS

| | | | |
|---|---|---|---|
| 3,321,329 | 5/1967 | de Vries | 427/183 |
| 3,615,734 | 10/1971 | Cole | 75/252 X |
| 3,781,170 | 12/1973 | Nakao et al. | 75/226 |
| 3,877,960 | 4/1975 | Knoss | 427/217 |
| 3,963,449 | 6/1976 | Seki et al. | 75/252 |

*Primary Examiner*—Shrive P. Beck

*Attorney, Agent, or Firm*—Cushman, Darby & Cushman

[57] ABSTRACT

A powder suitable for flame spraying which is a composition of an admixture of particles, 20–40% by volume of the particles being an alloy such as a nickel base alloy or cobalt base alloy, each containing aluminium and chromium and the balance of the composition are hollow glass particles, each hollow glass particle being coated with a nickel base alloy or cobalt base alloy, each containing aluminium and chromium. The powder, when flame sprayed, is effective as a thermal barrier which is resistant to thermal shock and oxidation.

12 Claims, No Drawings

COATING MATERIAL

This invention relates to coating materials and in particular to coating materials which are in powder form.

In the pursuit of greater efficiency and performance, the temperatures at which gas turbine engine components are required to operate are continually being increased. This leads in turn to the use of increasingly exotic materials in the construction of the components and perhaps the provision of elaborate cooling systems.

In order to avoid such expensive measures, it has been proposed to coat these components with ceramic materials in order to provide a thermal barrier which ensures that component temperatures are maintained within acceptable limits. Such ceramic coatings may, for instance, be applied by techniques such as flame spraying. However, ceramics are very brittle and tend to flake off components as those components expand and contract with temperature variations. This effect can be reduced by reducing the thickness of the ceramic coating but such thinner coatings are obviously less effective as thermal barriers.

In the co-pending Litchfield et al U.S. patent application Ser. No. 169,432, filed July 16, 1980, now U.S. Pat. No. 4,303,737 and assigned to the common assignee, Rolls-Royce Limited, Derby, England, a coating material is described as comprising hollow glass particles, each of which is coated with a nickel or cobalt base alloy containing aluminum and chromium. When flame sprayed on to a suitable surface, this coating material provides a thermal barrier of very low thermal conductivity. However, if it is utilised on surfaces which are subject to exteme conditions of oxidation and thermal shock for instance in the combustion equipment of a gas turbine engine, there is a tendency for it to flake off.

It is an object of the present invention to provide a coating material which, when it is coated on surface, is of relatively low thermal conductivity so as to provide an effective thermal barrier but which is nevertheless resistant to conditions of oxidation and thermal shock.

According to one aspect of the present invention, a powder suitable for flame spraying comprises an admixture of 20 to 40% by volume of particles of a nickel base alloy or cobalt base alloy, each containing chromium and aluminum and the balance particles of a glass, each of said glass particles being hollow and coated with a nickel base alloy or cobalt base alloy, each containing chromium and aluminium.

Throughout this specification, the term "flame spraying" is intended to include both combustion flame spraying and plasma spraying.

Said glass is preferably an alumino silicate glass.

Said glass preferably constitutes from 5 to 90% by weight of each of said coated glass particles.

Said coated glass particles are preferably within the size range 20 to 250 μm diameter.

Said nickel or cobalt base alloy particles are preferably within the size range 45 to 150 μm diameter.

According to a further aspect of the present invention, a method of coating a surface comprises flame spraying a powder in accordance with any previous statement of invention on to the surface to provide a coating with a depth within the range 0.2 to 7 mm.

The coating may constitute one layer of a multilayer coating, the other layer or layers being either metallic or ceramic in nature.

According to a still further aspect of the present invention, a method of coating a surface comprises applying a layer of a powder in accordance with any previous statement of invention to the surface and subsequently heating the powder at a temperature which is sufficiently high to sinter it.

The powder may be suspended in a liquid binder in order to facilitate its application to the surface, said binder being selected to evaporate or burn off at a temperature at or below said sintering temperature.

In order to investigate the resistance to oxidation and thermal shock of coatings comprising coating powders in accordance with the present invention, a series of comparative tests were carried out. More specifically, a series of test pieces were prepared, each consisting of a 2 mm thick sheet of the nickel base alloy known as "Nimonic 75", to which had been applied by flame spraying a bond coat of the nickel base alloy known as Metco 443 and a top coat of the coating powder under investigation. The bond coat was between 0.075 and 0.125 mm thick and the top coat of the coating powder under investigation between 0.5 and 0.75 mm thick.

The powder in accordance with the present invention consisted of an admixture of 20 to 40% by volume of particles of an alloy of the following composition:

Aluminium 4.5 to 7.5% by weight
Manganese 0 to 3.0% by weight
Carbon 0 to 0.3% by weight
Silicon 0 to 2.0% by weight
Chromium 15.5 to 21.5% by weight
Iron 0 to 1.5% by weight
Nickel balance.

Particle Size 45–150 μm. and the balance hollow alumino silicate glass spheres, each coated with an alloy containing by weight 80% nickel, 2.5% aluminium, 15.7% chromium and 1.8% silicon. The glass contained 31.97% $Al_2O_3$, 60.75% $SiO_2$, 4.18% $Fe_2O_3$, 1.91% $K_2O$ and 0.81% $Na_2O$, again all by weight. The uncoated spheres were about 20–200 μm in diameter and had a shell thickness of 2–10 μm.

The glass in this particular powder constituted 10% by weight of each coated particle. However, the glass may in fact constitute from 5 to 90% by weight of each particle.

After having the bond coat and top coat applied to them, each of the test pieces were then subjected to either oxidation or thermal shock testing. Testing for thermal shock resistance entailed heating the test piece for 2 hours at a temperature of 1050° C. and then immediately placing it in a cold air stream. This constituted one test cycle. The test cycles where then repeated until the top coating failed by flaking off the test piece. Testing for oxidation resistance entailed heating the test piece at a temperature of 1050° C. until oxidation of the top coat was detected by it flaking off the test piece.

The following results were obtained:

1. Thermal Shock Resistance

| Test Piece No. | Description of Coating | Flame Spraying Conditions. | No. of cycles to failure. |
|---|---|---|---|
| 1 | Bond Coat - Metco 443<br>Top Coat - Ni alloy coated glass spheres. | A | 1 |
| 2 | Bond Coat - Metco 443<br>Top Coat - 66% by vol. Ni alloy coated glass spheres, balance Ni | A | 50+ |

-continued

| | | | |
|---|---|---|---|
| | alloy particles. | | |
| 3 | Bond Coat - Metco 443<br>Top Coat - 80% by vol. Ni alloy coated glass spheres, balance Ni alloy particles. | B | 50+ |

2. Oxidation Resistance

| Test Piece No. | Description of Coating | Flame Spraying Conditions | No. of hours to failure. |
|---|---|---|---|
| 4 | Bond Coat - Metco 443<br>Top Coat - Ni alloy coated glass spheres. | A | 2 |
| 5 | Bond Coat - Metco 443<br>Top Coat - 66% by vol. Ni alloy coated glass spheres, balance Ni alloy particles. | A | 100+ |
| 6 | Bond Coat - Metco 443<br>Top Coat - 80% by vol. Ni alloy coated glass spheres, balance Ni alloy particles. | B | 100+ |

Flame spraying conditions A were as follows:
Gun type—Metco 5P
Nozzle type—P7-B
Powder part—11
Click setting—12
Acetylene flow—32 units
Oxygen flow—32 units
Air cap setting—20 psi (pinch)
Spray distance—6 inches.
Flame spraying conditions B were as follows:
Gun type—Metco 5P
Nozzle type—P7-B
Powder part—11
Click setting—12
Acetylene flow—29 units
Oxygen flow—29 units
Air cap setting—20 psi (pinch)
Spray distance—12 inches.

In the tests, test piece numbers 1 and 4 had a top coat of the nickel alloy coated glass spheres only. These test pieces thus served to provide a standard from which the performance of the coatings produced from powders in accordance with the present invention could be judged. Examination of the results reveals that in all instances, the test pieces provided with coatings in accordance with the present invention withstand 50 thermal shock cycles and 100 hours at 1050° C. without failure through thermal shock or oxidation.

In addition to being suitable for combustion spraying, it is envisaged that powders in accordance with the present invention could be plasma sprayed on to a surface or applied to a surface in the form of a slurry with a suitable liquid binder. If the powder is applied in the form of a slurry, subsequent heating steps would be required in order to evaporate or burn off the binder and sinter the particles. A suitable binder would be one which evaporates or burns off at or below the sintering temperature and could, for instance be an organic resin which will burn off with little residue, for instance a polymethacrylic ester resin.

Whilst coatings which are formed by the slurry technique are effective as thermal barriers, their degree of porosity makes them suitable for use in the manufacture of abradable seals. Thus the coatings could be applied to the radially inner surfaces of an axial flow gas turbine engine compressor so as to be abraded in operation by the tips of the rotating aerofoil blades of the compressor.

The present invention has been described with reference to an admixture containing hollow alumino silicate glass spheres coated with an alloy of nickel, aluminium, chromium and silicon. It is envisaged, however, that other suitable nickel base alloys containing aluminium and chromium could be utilised as well as cobalt base alloys containing chromium and aluminium. Moreover, other suitable glasses could be used in place of the alumino silicate glass and the other nickel base alloy particles of the admixture could be formed from an alloy other than that set out in the above description. Thus the other particles could be of different nickel base alloy containing aluminium and chromium or indeed a cobalt base alloy containing aluminium and chromium.

Whilst the present invention has been described with reference to coatings which are between 0.5 and 0.75 mm thick, it will be appreciated, that other thicknesses could be utilised depending upon the particular application of the coating. Thus we believe that coatings in accordance with the present invention may be between 0.2 and 7 mm thick and still function effectively as thermal barriers. Moreover it will also be appreciated that coatings in accordance with the present invention may be applied in conjunction with coatings of other materials in order to provide a "sandwich" type structure. Thus it is usually desirable to provide a bond coat between the coating in accordance with the present invention and the surface to be protected. Alternatively or additionally, a further coating which may be metallic or ceramic may be applied on top of the coating in accordance with the present invention. This may be necessary in, for instance, particularly erosive, corrosive or oxidising environments.

We claim:

1. A powder suitable for flame spraying comprising a composition of an admixture of particles in which 20 to 40% by volume of the particles are an alloy selected from the group consisting of a nickel base alloy containing aluminium and chromium and a cobalt base alloy containing aluminium and chromium, and the balance of the particles are of a glass composition, each of said glass particles being hollow and coated with an alloy selected from the group consisting of a nickel base alloy containing chromium and aluminium and a cobalt base alloy containing chromium and aluminium.

2. A powder as claimed in claim 1 wherein said glass is an alumino silicate glass.

3. A powder as claimed in claim 1 wherein said glass constitutes from 5 to 90% by weight of each of said coated glass particles.

4. A powder as claimed in claim 1 wherein said coated glass particles are within the size range 20 to 250 μm diameter.

5. A powder as claimed in claim 1 wherein said alloys selected from the group consisting of nickel base alloy and cobalt base alloy are within the size range 45 to 150 μm diameter.

6. A powder suitable for flame spraying comprising a composition of an admixture of particles in which 20 to 40% by volume of the particles are an alloy containing, by weight, 4.5 to 7.5% aluminium, 0 to 3.0% manganese, 0 to 0.3% carbon, 0 to 0.2% silicon, 15.5 to 21.5% chromium, 0 to 1.5% iron and the balance nickel, and the balance of the particles of said admixture particles are of a glass composition, each of said glass particles being hollow and coated with an alloy selected from the group consisting of a nickel base alloy containing chromium and aluminium and a cobalt base alloy containing chromium and nickel.

7. A powder suitable for flame spraying as claimed in claim 6 wherein said glass particles are coated with an alloy comprising, by weight, 80% nickel, 2.5% aluminium, 15.7% chromium and 1.8% silicon.

8. A powder as claimed in claim 6 wherein said glass comprises, by weight, 31.97% $Al_2O_3$, 60.75% $SiO_2$, 4.18% $Fe_2O_3$, 1.91% $K_2O$ and 0.81% $Na_2O$ and constitutes 10% by weight of each of said coated particles.

9. A method of coating a surface comprising flame spraying the powder of claim 1 onto a surface to provide a coating with a depth within the range 0.2 to 7 mm.

10. A method of coating a surface as claimed in claim 9 wherein said coating constitutes one layer of a multilayer coating the other layer or layers being selected from the group consisting of metals and ceramics.

11. A method of coating a surface comprising: (1) applying a layer of the powder of claim 1 onto a surface, and (2) subsequently heating the applied powder at a temperature which is sufficiently high to sinter it.

12. A method of coating a surface as claimed in claim 11 wherein the powder is suspended in a liquid binder in order to facilitate its application to the surface, said binder being selected to evaporate or burn off at or below said sintering temperature.

* * * * *